United States Patent [19]

Pessina et al.

[11] 4,204,671

[45] May 27, 1980

[54] SHEET STACKING MACHINE

[76] Inventors: Giorgio Pessina; Aldo Perobelli, both of Via Arborina 2, Paderno Dugnano, Italy

[21] Appl. No.: 913,322

[22] Filed: Jun. 7, 1978

[30] Foreign Application Priority Data

Nov. 3, 1977 [IT] Italy ..... 22637/77[U]

[51] Int. Cl.[2] ..... B65H 29/68

[52] U.S. Cl. ..... 271/186; 271/203

[58] Field of Search ..... 271/272, 277, 186, 198, 271/202, 203

[56] References Cited

U.S. PATENT DOCUMENTS

| | | | |
|---|---|---|---|
| 2,933,313 | 4/1960 | Stobb | 271/202 X |
| 3,436,073 | 4/1969 | Christmas | 271/186 |
| 3,542,362 | 11/1970 | Brockmuller | 271/202 |
| 3,945,635 | 3/1976 | Marin | 271/202 |

*Primary Examiner*—Richard A. Schacher

*Attorney, Agent, or Firm*—Kirschstein, Kirschstein, Ottinger & Cobrin

[57] ABSTRACT

A stacking machine is proposed which is enabled to stack sheets or signatures being fed continuously either singly or in overlapped relationship, the machine comprising a rotatable roller partially encircled by a first set of belts. A second set of belts is movable facing the first set of belts along a portion thereof to define a passage for the sheets. The second set of belts is entrained by a free-wheeling clutch driven by the driving means which drives the roller. The belts are driven constantly, and a difference of speed with respect to the peripheral speed of the driving roller, as due to thickness variations of the sheets or signatures, is compensated for by the free-wheeling mechanism.

3 Claims, 2 Drawing Figures

SHEET STACKING MACHINE

BACKGROUND OF THE INVENTION

1. Field of the Invention

This invention relates to a sheet stacking machine, whereby sheets or signatures can be stacked which are fed continuously as signatures and/or single or overlapping sheets.

2. Description of the Prior Art

Known in the art is a stacking machine of that general type, wherein to an entraining roller, partially encircled suitable conveying belts, is associated a series of further conveying belts which are mounted idle and driven by frictional engagement of the sheets or signatures being fed with the belts around the rotatively driven roller and related idle travelling belts.

The shortcoming of this prior art device is that the friction force between the sheets and idle-mounted belts is not always sufficient to ensure correct operation of the stacking machine, where it may happen that the sheets and/or signatures to be stacked—owing to this very conveying fault—jam the conveying belt means, thus requiring that the machine be stopped to free the latter of the sheets and/or signatures jammed in the conveying means.

An attempt has been made at driving also the outer belts facing the conveying belts over the rotating roller, but this involves difficulties hitherto unobviated, because owing to the variable thickness dimension of the overlapping signatures and/or sheets, there occurs a differential of peripheral speed between the belts linked to the driven conveying roller and the set of outer belts cooperating with the ones on the rotating roller.

OBJECTS OF THE INVENTION

It is an object of this invention to obviate the drawbacks encountered in the prior state of the art, avoiding in particular the difficulties introduced by the idle belts facing the ones of the rotating roller, by driving those belts such as to compensate for any difference in the peripheral speed with respect to that of the rotating roller belts.

SUMMARY OF THE INVENTION

The cited object is achieved by this invention providing a machine for stacking sheets and/or signatures fed continuously either singly or in overlapped relationship, characterized in that motion is transferred to the guide belts facing the guide belts of the rotating roller with the interposition of a driving mechanism having a free-wheeling or unidirectional clutch device.

By providing a free-wheeling type of driving mechanism for driving the belts which surround the belts of the rotating roller, the advantage is secured that said belts are driven continuously and that any peripheral speed differential with respect to the rotating roller, as due to thickness variations in the signatures and/or sheets, is fully compensated for by the free-wheeling clutch mechanism.

Further features and advantages of the invention will become apparent from the ensueing detailed description, as well as from the appended claims and accompanying drawings.

BRIEF DESCRIPTION OF THE DRAWINGS

The invention will be next described more in detail with reference to an exemplary embodiment thereof, illustrated in the accompanying drawings, where.

DESCRIPTION OF THE PREFERRED EMBODIMENT

Figure 1:
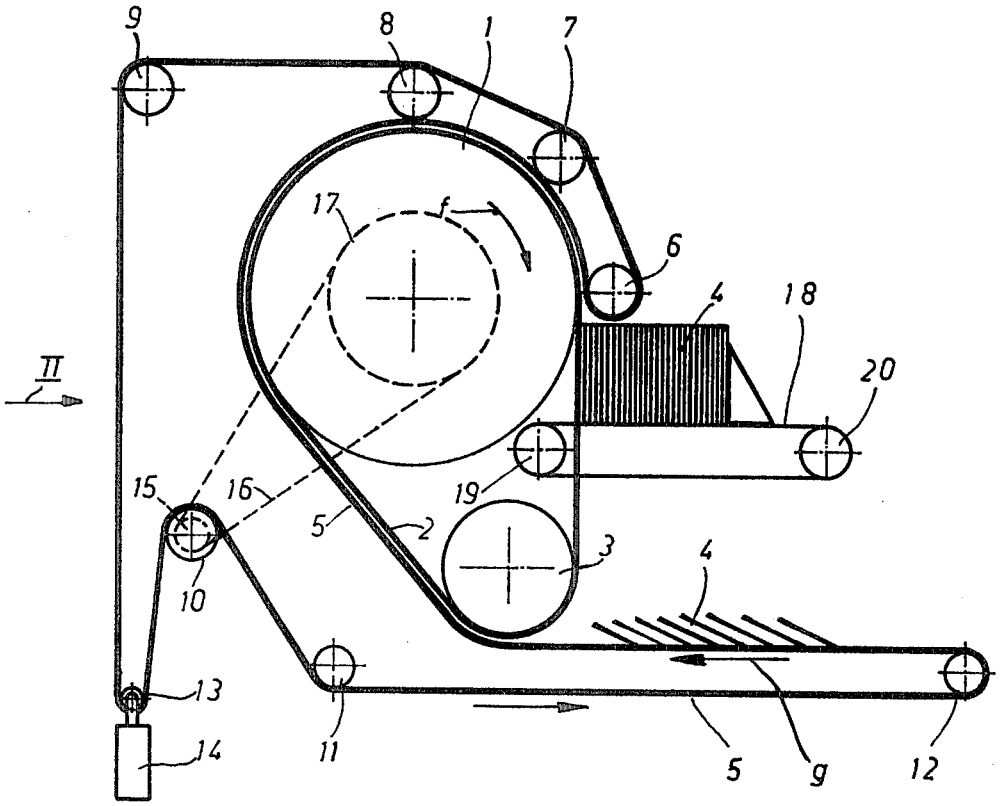
FIG. 1 is a schematic side view of the essential components of a stacking machine according to this invention.

As illustrated in FIG. 1, the instant stacking machine comprises a roller 1, whereto is transmitted a rotary motion in the direction of the arrow f by a driving means in the form of a motor or the like. The roller is first encircled by a first series or set of narrow belts 8 which are spaced apart from one another and guided at the bottom by a roller 3. Overlapped sheets, respectively signatures, 4 are fed through a second series or set of belts 5, also spaced apart from one another.

Each belt 5 has a portion that travels in the direction of the arrow g, to define a feeding means for feeding the signatures or sheets 4 to the roller 3, and accordingly to the roller 1. To this purpose, each belt 5 is made to follow from the roller 3 a portion of the path of the corresponding belt 2, being passed around the roller 1 to a tensioning guide roller 6, whereat the movement of the belts 5 is reversed to return, through rollers 7,8,9,10, and 11, to a tensioner roller 12 which forms the start of the feeding section for the sheets and/or signatures 4. Thus, the belts 5 of the second set of belts move along a path having a portion surrounding the belts 2 of the first set of belts at the portion thereof encircling the roller 1, to define with the belts 2 of the first set of belts, in operation, a passage for the sheets and/or signatures 4.

Advantageously, each belt 5 cooperates with a jockey or belt tensioning roller 13, which is suitably ballasted with a weight 14. The roller 10 receives its rotary motion through a free-wheeling, i.e. unidirectional, type of drive mechanism 15, which is connected for rotation with the roller 1 by a belt or chain 16, or other similar means, in turn driven by a sprocket or the like 17 which rotates along with the roller drum 1.

The operation of the free-wheeling clutch mechanism 15 will be described more in detail hereinafter.

Advantageously, the height of the tensioner roller 6 is made adjustable, such as to adjust the machine to different heights of sheets and/or signatures 4 which are disposed in a conveyor arrangement on a receiving means in the form of a conveyor belt 18 which is guided and driven by two rollers, respectively 19 and 20. As visible in FIG. 1, the roller 1 is arranged proximate to the receiving means.

The inventive machine operates as follows.

The sheets and/or signatures 4 being fed in overlapped relationship at the roller 12 on the belts 5 which travel in the direction of the arrow g, move towards the roller 3 whereat the sheets and/or signatures 4 are clamped between the belts 5 and belts 2 of the rotating roller 1. Thus, the sheets and/or signatures 4 are entrained and transferred by the roller 1, corresponding belts 2, and belts 5, to the roller 6, whereat the sheets and/or signatures 4 are discharged downwards for stacking onto the conveyor 18.

By providing a free-wheeling clutch mechanism 15 for driving the belts 5, faulty feeding of the sheets and/or signatures 4 to the nip between the belts 2 and conveying belts 5 is effectively prevented. This difficulty is obviated because the belts 5 are also driven by the clutch mechanism 15, thereby the sheets and/or signatures 4 can be transferred without problems.

The peripheral speed differential between the circumference of the roller or drum 1, and accordingly the belts 2, and the corresponding belts 5, which differential is due to the longer path followed by the outer belts 5 on account of an increased thickness of the sheets and/or signatures 4 between the belts 5 and belts 2, is automatically compensated for by the free-wheeling clutch mechanism 15. As that speed differential tends to become zero, or when the peripheral speed of the belts 5 tends to drop slightly below the peripheral speed of the belts 2, the free-wheeling clutch mechanism cuts in to transmit motion to the respective belts 5.

If, by contrast, owing to the increased thickness of the sheets 4 the peripheral speed of the belts 5 exceeds the roller peripheral speed, then the free-wheeling clutch mechanism 15 cuts out to allow these different peripheral speeds and to balance any angular speed difference between the roller 1 and belts 5.

It follows, therefore, that the free-wheeling clutch mechansim 15 positively drives the second set of belts 5 when the sheets 4 have a thickness below a given value and acts as an overrunning clutch when the sheets 4 have a thickness above this given value.

The essential components of a maching according to the invention are shown schematically in FIG. 1.

Figure 2:
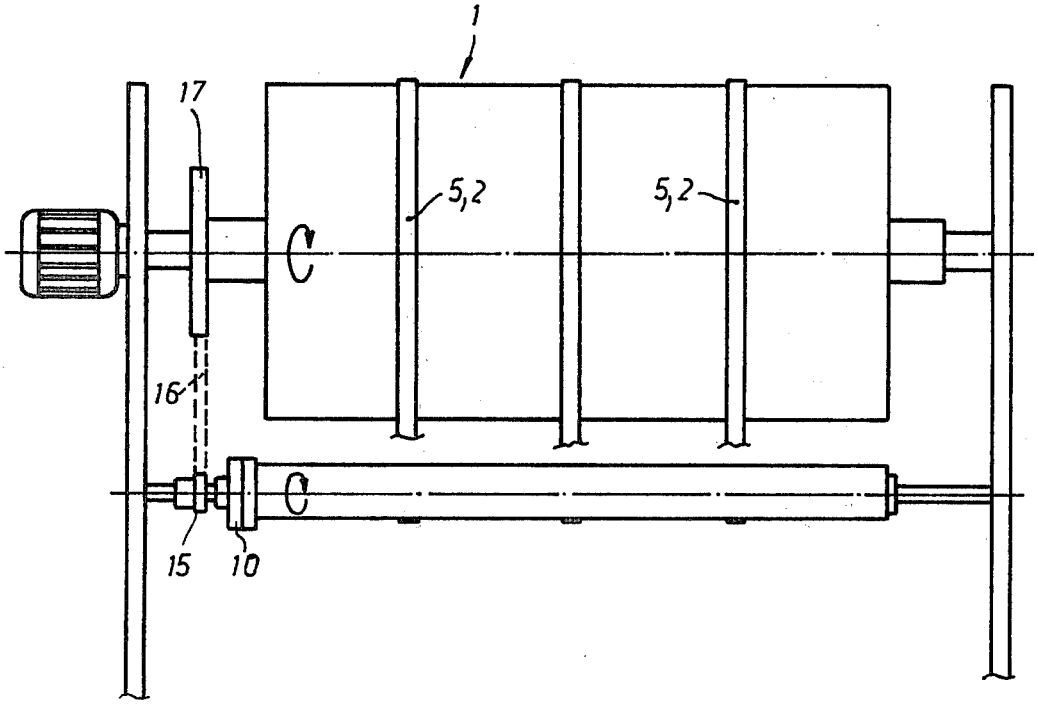
FIG. 2 is a front view, in the direction of the arrow II in FIG. 1, of the essential components of a machine according to the invention.

In FIG. 2, there is shown schematically only the roller 1 and related driving motor, sprocket 17, drive belt or chain 16, and the free-wheeling clutch mechanism 15 for driving the conveyor belts 5. Other mechanical members shown in FIG. 1, have been omitted from FIG. 2 for clarity.

The advantage to be secured with this invention residues particularly in that an extremely simple construction has been provided, through an effective one, which affords reliable transfer of the sheets and/or signatures 4 in a stacking machine, and the added capability of driving both the conveying roller 1 with its belts 2, and the outer belts 5 surrounding for a given circumferential portion said roller 1, thereby said belts 5 can also be driven, while making it possible to effectively compensate any difference in the peripheral speeds of the belts 2 and belts 5, which difference originates from a variation in the thickness dimension of the sheets and/or signatures 4 being fed between the belts 5 and 2.

What is claimed is:

1. A machine for stacking sheets, said machine comprising:

(A) means for feeding said sheets, (B) means for receiving said sheets and disposing said sheets in a stacked arrangement, (C) a roller proximate to said receiving means, (D) means for driving said roller, (E) a first set of spaced belts, (F) means to guide said first set of belts for movement along a path having a portion partially encircling said roller and a portion extending between said feeding means and said receiving means, (G) a second set of spaced belts, (H) means to guide said second set of belts for movement along a path having a portion surrounding said first set of belts at said portion encircling said roller to define with said first set of belts, in operation, a means for transferring said sheets between said feeding means and said receiving means, and a free-wheeling clutch having a driving member and a driven member, said driving member being driven for rotation by said driving means for said roller, and said driven member being in operative engagement with said second set of belts, said clutch being engaged when the peripheral speed around the roller of the second set of belts drops to or below the peripheral speed around the roller of the first set of belts and being free-wheeling when the peripheral speed around the roller of the second set of belts exceeds the peripheral speed of the roller of the first set of belts, whereby the free-wheeling clutch is operative when the sheets have a thickness below a given value and disengages and acts as an overrunning clutch when the sheets have a thickness above said given value.

2. A stacking machine as claimed in claim 1, wherein said free-wheeling clutch is connected for rotation with said roller.

3. A stacking machine as claimed in claim 1, wherein said belts of said second set of belts each have a portion moving toward said roller and defining said feeding means.

* * * * *